United States Patent [19]

Mansfield

[11] 4,199,136

[45] Apr. 22, 1980

[54] FLEXIBLE SHEET EXERCISING APPARATUS

[76] Inventor: Stanley J. Mansfield, 2255 Cahuengo Blvd., Los Angeles, Calif. 90068

[21] Appl. No.: 803,229

[22] Filed: Jun. 3, 1977

[51] Int. Cl.[2] ..... A63B 5/08

[52] U.S. Cl. ..... 272/65; 272/DIG. 4

[58] Field of Search ..... 272/65, 66, 109, 135, 272/116; 182/222, 179, 112; 248/251

[56] References Cited

U.S. PATENT DOCUMENTS

| | | | |
|---|---|---|---|
| 2,730,412 | 1/1956 | Yoder | 182/112 X |
| 3,850,264 | 11/1974 | Salinas | 182/179 X |
| 4,018,438 | 4/1977 | Shoger | 272/65 |

FOREIGN PATENT DOCUMENTS

| | | | |
|---|---|---|---|
| 2631067 | 1/1977 | Fed. Rep. of Germany | 272/65 |
| 27983 | 10/1955 | Finland | 272/66 |

*Primary Examiner*—William R. Browne

*Attorney, Agent, or Firm*—Poms, Smith, Lande & Rose

[57] ABSTRACT

An exercising apparatus is similar in its mode of action to a trampoline, and uses a flexible semi-rigid and elongated sheet which may be made of plastic or metal. A frictional pad is provided to avoid slipping as the user bounces on the apparatus. The flexible sheet may be supported at both ends either by a structure which is secured to both ends of the elongated flexible sheet, or by supports upon which it rests. In order to accommodate both heavy and light persons, and persons who want more vigorous bouncing action than those who desire less bounce, the apparatus is provided with various arrangements for increasing or decreasing the deflection versus force characteristic. In one species of the invention the underside of the elongated flexible sheet is provided with a number of grooves for selectively engaging the underlying support either closer or farther away from the end of the sheet. In another embodiment two sheets of different flexibility are provided and the apparatus may be turned over to get greater or lesser flexibility. In another embodiment made of one piece of metal with the ends turned under, arrangements are provided for mechanically engaging the upper and lower portions, thereby reducing the effective length of the flexible member. The supports may be provided with underlying rubber cushions with frictional engagement with the floor.

4 Claims, 8 Drawing Figures

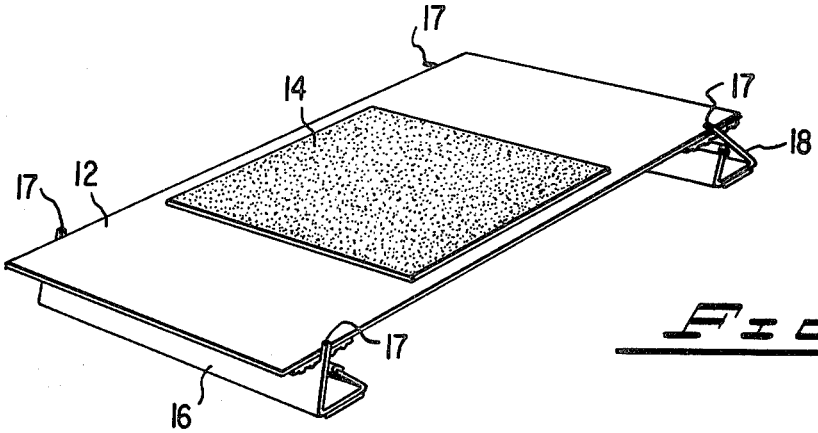
Fig. 1
Fig. 2
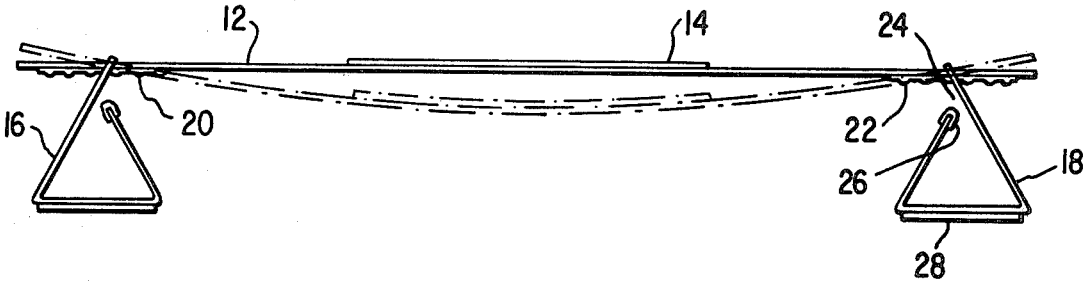
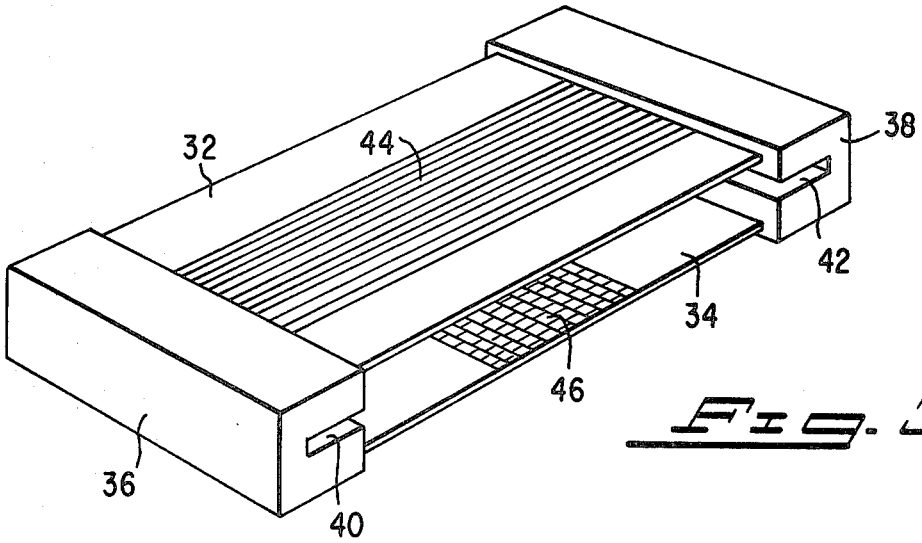
Fig. 3

FLEXIBLE SHEET EXERCISING APPARATUS

BACKGROUND OF THE INVENTION

This invention relates to exercising devices.

It is well known that mild forms of exercise are healthful, and such mild exercise is frequently prescribed by doctors for patients who wish to improve their physical condition, or who are recovering from various physical problems including mild heart attacks. However, it is often difficult and inconvenient for persons to obtain the needed exercise in a simple manner. Thus, jogging is a form of exercise which is often recommended but is not suitable for many persons. Other possibilities such as long walks or bicycle riding are often not practical either because of the physical or social conditions in the area where a person is located.

One form of exercise which is generally considered to be most desirable is the bouncing action which may be performed on a trampoline. Trampolines, however, can be very dangerous and they can throw persons in directions which are somewhat unexpected. Even skilled and highly trained athletes have been severely injured and even paralyzed when using a trampoline.

A principal object of the present invention is to provide a simple and convenient way of obtaining exercise, and one which may be utilized at home, in the office, in a hotel room, or in any other location where a few square feet of space is available.

SUMMARY OF THE INVENTION

In accordance with the present invention an exercising apparatus is provided which includes an elongated, flexible, semi-rigid sheet member which may for example be made of metal or plastic. The sheet member is provided with frictional arrangements for preventing slippage when a person is exercising by springing on the unit and also includes, of course, arrangements for supporting the elongated sheet at both ends. Also provided are suitable arrangements for varying the flexibility, or the deflection versus force characteristic, to accommodate persons of differing weights and those desiring more or less vigorous exercise.

In accordance with one feature of the invention the flexibility may be adjusted by varying the effective point of support of the ends of the elongated sheet member. This may conveniently be accomplished through the use of transverse grooves in pads secured to the underside of opposite ends of the elongated sheet. Separate support members may be positioned in one of the many grooves to provide the desired degree of flexibility.

In accordance with another feature of the invention the separate supports at each end of the apparatus may be provided with stops or protrusions at each end which extend around the sides of the sheet to prevent the sheet from sliding off the two supports as exercise is undertaken.

When separate independent end supports are employed, they may be channel-shaped, and flexible to easily reduce the distance between the two support points by bending the supports as the flexible sheet member flexes and reduces the distance between the two support points.

In accordance with a feature of the invention, the exercising apparatus includes a flexible sheet which is in the order of three feet or less in length and preferably about two feet long, which is mounted at both ends so that it is about three inches or more off the floor, and which deflects in the order of one inch or more when a person having a weight of between 75 and 300 pounds stands still on the sheet. With light bouncing the sheet may deflect plus or minus one-quarter inch from its deflected rest position, and with more vigorous bouncing a deflection of up to about one inch or more in each direction from the neutral position is obtained. It may be noted in passing that plus and minus ¾ inch, giving an amplitude of oscillation of 1½ inches, for a twenty-two inch length, would correspond to an amplitude equal to about 6% or 7% of the length of the sheet. By changing the effective length of the sheet as disclosed herein, by varying the support points, for example, much the same deflections may be obtained for lightweight users as for heavier users.

Summarizing the aspect of the invention outlined in the previous paragraph, therefore, the flexible sheet used in the present exercising apparatus should have sufficient flexibility to deflect by three percent or five percent of its length, when a person stands on it in the rest position; and to have an amplitude of oscillation of five percent or more under vigorous oscillating usage.

One important advantage of the present exercising apparatus is the lack of impact of the type which occurs in jogging, for example. Such impact is believed to generate lactic acid, and frequently causes sore muscles, or other physical problems for persons who are not in perfect condition and health. The smooth harmonic motion of the present exercising device creates no impact in the anatomy of the user, and therefore provides safe and healthful exercise without adverse after effects.

Other objects, features, and advantages of the invention will become apparent from a consideration of the following detailed description and from the drawings.

BRIEF DESCRIPTION OF THE DRAWINGS

FIG. 1 is an isometric view of an exercising device illustrating the principles of the present invention;

FIG. 2 is a cross-sectional view of the apparatus of FIG. 1;

FIG. 3 is an isometric view of an alternative embodiment of the invention;

DETAILED DESCRIPTION

Figure 4:
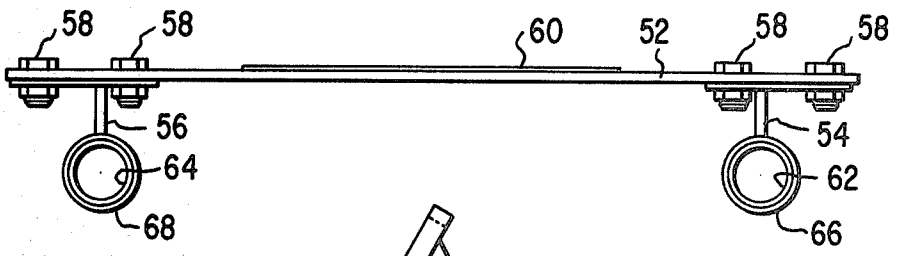
FIG. 4 is a side view of another species of the invention.

Referring more particularly to the drawings, FIGS. 1 and 2 show isometric and side views, respectively, of a preferred embodiment of the invention. In these showings, the aluminum plate 12 is provided with a central frictional pad 14 on which the person who is using the exercise device stands. At each end of the flexible aluminum sheet 12 are support members 16 and 18. Secured to the bottom of the aluminum plate 12, on the other side from the frictional pad 14 are rubber pads 20 and 22. These rubber pads 20 and 22 extend the width of the aluminum plate and have a large number of ridges which also extend transversely of the aluminum plate 12. The ridges in the rubber pads 22 may be spaced apart by approximately ¼", and with the rubber pads 20 and 22 being approximately ⅛" thick, the ridges are approximately 1/16" high.

The aluminum plate 12 may be approximately 14" wide by 24" long and ⅛" thick. Successful results have been employed using aluminum sheet material of the type designated 7075-T6. It is understood that this designation refers to the composition and the heat treatment of the particular type of aluminum which is employed. As mentioned below, other materials may be employed, including plastics such as fiberglass or polycarbonate. With the length of the aluminum sheet being approximately 24", it has been determined that a person weighing between 290 and 300 pounds would locate the supports 16 and 18 in the ridges of pads 20 and 22 which are near the inner edges of the two pads, thus providing a spacing of about 19". It has also been determined experimentally that with a person having a weight of about 140 pounds, the proper spacing is about 21½", while a person weighing about 70 or 80 pounds the supports should be spaced nearly as far apart as possible, or about 23" apart.

The members 16 and 18 may be channel-shaped, as shown, with approximately 60° at each angle and the space 24 together with the rubber strip of U-shaped configuration 26 providing an effective stop against undue bending of the member 18. A rubber pad 28 is provided on the lower surface of the end support 18, to provide good frictional engagement with smooth floors such as wood and concrete floors. The end supports 16 and 18 serve to mount the aluminum plate 12 approximately 3⅛" above the floor. It may be noted in passing that, when the aluminum sheet 12 is bent or flexed, as shown in FIG. 2, that the support points are brought somewhat closer together. The supports 16 and 18, however, also flex as additional pressure is applied to them, and shift the support point inward, to accommodate this reduced spacing.

At each end of each of the supports 16, 18 are protrusions 17 which hold the flexible sheet 12 against lateral movement relative to the supports.

FIG. 3 shows an alternative embodiment of the invention employing two fiberglass sheet members 32 and 34 of different thickness. More specifically, the upper sheet 32 may be 3/16" thick, while the lower sheet 34 may be 5/16" in thickness. The two fiberglass sheets 32 and 34 are both 28" long, and they are mounted at each end in semi-resilient blocks 36 and 38 made of plastic, and which may be made of a type of urethane plastic. The blocks which were actually used were grooved to receive the sheets 32 and 34, and were provided with additional grooves 40 and 42 to increase their resiliency. The urethane material is somewhat resilient so that it cushions the unit when it is used on a bare wood floor, for example. Thus, when the fiberglass sheets are not inserted into their slots, the blocks may be easily deformed by hand, but within a second or two the material flexes back out to resume its original position.

In practice, lightweight persons use the exercise unit of FIG. 3 in the position shown, with the thin sheet oriented to the top; whereas heavier persons weighing close to 200 pounds or more, would reverse the unit from the position shown in FIG. 3, and bounce on the 5/16" thick sheet 34. Both of the two fiberglass sheets are provided with frictional surfacing material 44 (for sheet 32) and 46 (for sheet 34).

FIG. 4 shows a third embodiment of the invention utilizing an aluminum sheet 52 and two adjustable support members 54 and 56. Each of the adjustable support members 54 and 56 are bolted to the aluminum sheet 52 by relatively flat bolts 58. By reversing the orientation of the support members 54 and 56, the effective support point for the sheet 52 may be spaced further or at lesser distance apart to vary the flexibility of the aluminum sheet. In addition, by reversing only one of the two end supports, an intermediate level of flexibility may be secured.

As in the case of the embodiment of FIGS. 1 and 2, a frictional pad 60 may be secured to the aluminum sheet 52. In addition, the cylindrical feet 62 and 64 of the support members 54 and 56 may be provided with resilient sleeves 66 and 68 of rubber to bear on a hard flooring surface.

Incidentally, the width of the aluminum sheet 52 may be approximately 14" and its length may be approximately 23" or 24". The support members 54 and 56 may extend the full width of the sheet; however, the vertically extending portion of these supports may be of reduced width such as 10", for example, to permit the 14" long cylindrical members 62 to be encircled by the rubber sleeves 66 for a couple of inches at each end of each of the supports.

Figure 5:
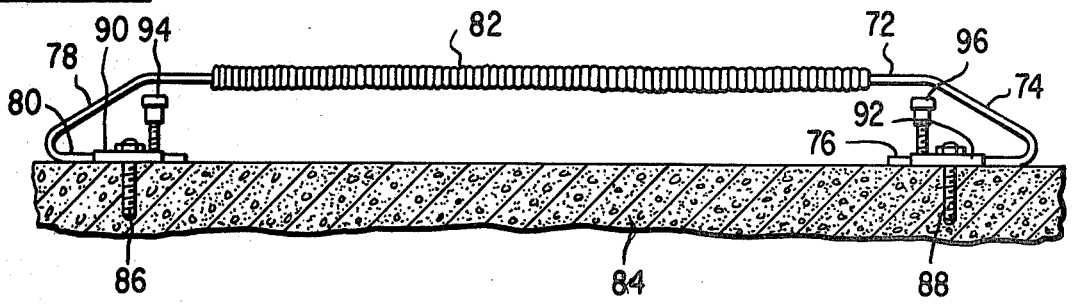
FIG. 5 is a side view of yet another embodiment of the invention.
Figure 6:
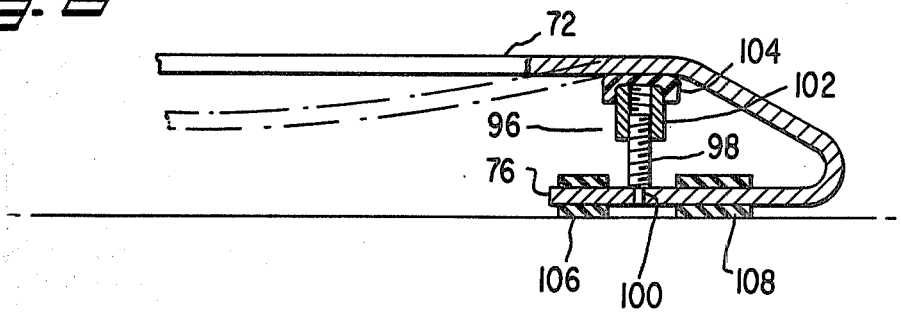
FIG. 6 is an enlarged view of an adjustment mechanism which may be employed in the implementation of the species of FIG. 5.

The embodiment of FIGS. 5 and 6 utilizes a single strip of metal 72 which is bent back upon itself, with the slanting portion 74 and the underlying portion 76 at one end, and a similar slanting portion 78 and underlying portion 80 at the other end.

Suitable frictional material such as a wrap 82 provides frictional engagement for persons using the exercising apparatus. In the arrangement shown in FIG. 5 the apparatus is bolted into a concrete floor 84 by bolts 86, 88 utilizing lock plates 90, 92 and holes through the underlying ends 76 and 80 of the metal plate 72.

FIG. 6 shows a detail of the adjusting screws 94, 96 which serve to adjust the tension and resilience of the exercising device including the plate 72. More specifically, the screws 94 and 96 may be turned so that the effective length of the free portion of the strip 72 is substantially reduced. As shown in FIG. 6, the assembly 96 includes a threaded stud 98 which is provided with a reduced diameter portion 100 which is threaded into a tapped hole in the underlying portion 76 of the strip 72. A cylindrical threaded member 102 engages the larger diameter threaded portion of the stud 98 and is provided with an upper rubber tip 104. When the threaded sleeve 102 is turned upwardly the rubber member 104 engages the aluminum sheet 72 and supports it firmly, thus reducing its flexibility. It is contemplated that three of the studs such as are shown at 94 and 96 in FIG. 5, and at 96 in FIG. 6, are provided at each end so that the strip 72 may be firmly supported at both ends when all six of these adjustments are in the raised position.

In FIG. 5, as mentioned above, the exercising device has been shown bolted down in position. This arrangement is preferred for permanent installations. However, units of the type shown in FIG. 5 may also be portable, and for such applications, resilient strips such as those shown at 106, 108 may be secured to the inturned ends 76, 80 of the extended metal sheet members 72.

Figure 7:
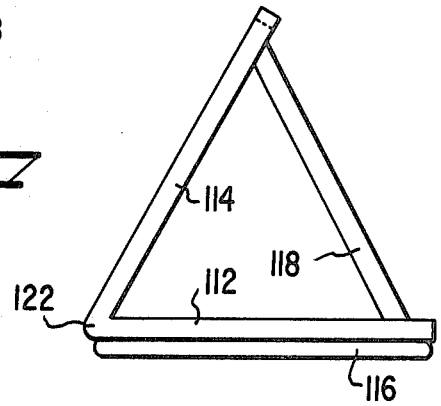
FIGS. 7 and 8 are end views and side views, respectively, of an alternate support member to be used with the flexible sheet of FIG. 1.
Figure 8:
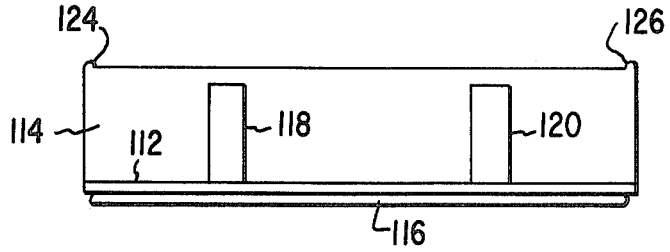

FIGS. 7 and 8 show an end view and a side view, respectively, of an alternative support for the plate 12 of FIG. 1. More specifically, the support of FIGS. 7 and 8 include an angled sheet member having a horizontal portion 112 and an upwardly inclined portion 114. The two sheet members 112, and 114 which may, for example, be made of a single piece of sheet metal, have an angle with respect to one another of approximately 60° so that they are approximately in the configuration of two of the three sides of an equilateral triangle. The lower member 112 may be cushioned by a suitable rubber pad 116. Two bracing members 118 and 120 are secured between the two sheet metal members 112 and 114 to insure that the stresses applied to the two members are not sufficiently great so that the elastic limit is exceeded and sheet metal member 114 will break from its associated sheet metal member 112 at the corner 122. These supports may be made either through extrusion, by welding two flat sheet metal members together, or by bending a single sheet metal member longitudinally. Subsequently to forming the angled members 112 and 114, the braces 118 and 120 may be secured to them by welding or other suitable techniques.

When employed with a flexible sheet member 14 inches in width, such as that shown in FIG. 1, the support of FIGS. 7 and 8 may be 14½ inches in length to provide retaining tips 124 and 126 to extend beyond each side of the sheet member 12.

In the foregoing description, several different embodiments have been disclosed. Other possibilities would also be practical for providing the flexible sheet with variable resiliency to accommodate persons of different weights. For example, an aluminum sheet may be provided with a pair of fairly closely spaced supports on one side and more extended supports on the other side. This could be accomplished, for example, by securing aluminum tubes or pipes to one side of the flexible sheet 12 as shown in FIGS. 1 and 2 with the three inch diameter aluminum tubes spaced apart by 19 inches, and with two additional tubes on the other side spaced apart by 22 inches. The four tubes could be secured to the aluminum sheet by any suitable means such as bolting, welding, or the like. Then, when a lightweight person is using the unit, it is oriented with the 22 inch spacing tubes down to give increased flexibility; and when a heavier person is using the unit, the two tubes with 19 inch spacing are facing down to reduce the flexibility. Similarly, a double pair of end supports of the type shown in FIGS. 5 and 6 may be employed with one of the sets of supports facing upwardly while the other is facing downward as shown. However, of course, the two supports would have different spacing from end to end to provide different flexibility. This arrangement could be implemented by providing two complete units with a laminated unit of proper flexibility extending for the main portion of the length of the flexible sheet; or alternatively the arrangement could be implemented by merely adding additional supports to the units of FIGS. 5 and 6 and securing them to the upper surface of the sheet 72 spaced somewhat inwardly from the present supports, so that when the unit is reversed the resiliency is reduced. Concerning another alternative, with reference to FIG. 1, the underlying rubber pads 22 are shown as holding the supports in their proper relative positions. Instead of having a separate rubber pad, the ends of the sheet 12 may be formed with a grooved or rippled construction, formed either by machining, or by extrusion, and the upper matching edge of the underlying triangular supports could be provided with a U-shaped rubber covering to provide the desired rubber-to-metal engagement between the two surfaces. In addition, of course, instead of a separate frictional mat as shown at 14 in FIG. 1, the surface of the sheet 12 may be made with a roughened texture, to avoid slipping. Concerning the supports employed in the arrangement of FIG. 1, instead of triangular supports such as are shown in FIGS. 1, 2 and 7, a T-shaped support may be employed with the sheet 12 making rocking engagement with one of the three triangular points of the "T" of the transversely-extending support member.

With regard to the materials which may be employed in the implementation of the present invention, successful results have been achieved using fiberglass and aluminum. Other materials such as polycarbonates, and other metals and plastics may of course be employed.

What is claimed is:

1. A lightweight, portable, exercising apparatus comprising a rectangular, substantially unconstrained, semi-rigid sheet member, less than 3 feet in length and less than 1½ feet in width, said sheet member being horizontally disposed and sufficiently flexible so that it deflects by approximately 3% to 5% or more of its length when a person of normal weight stands on it;

stable transverse support means for supporting said sheet member and for permitting unrestrained vertical movement of said sheet member during an exercise program, said transverse support means having a substantial length and, extending across each of the end portions of the underside of said sheet member, for supporting said sheet member above a floor by less than 6 inches so that the center of gravity of said apparatus is close to the floor, said support means including spaced members for restraining opposite lateral movements of said sheet member;

said apparatus further including adjusting means for selectively positioning the transverse support means with respect to the sheet member, and said adjusting means including a plurality of notches at each end of said apparatus, for longitudinally shifting the position of said support means relative to said sheet member to change the distance between the support lines for said sheet member, thereby adjusting the deflection versus load characteristic of said sheet member to a predetermined plurality of discrete settings to accommodate persons of different weight; and a friction means attached to said sheet member for avoiding slipping when a person stands, sits, or bounces on said sheet member.

2. An exercising apparatus as defined in claim 1, wherein said member for restraining lateral movement includes a portion of said support means extending above both sides of said sheet member.

3. An exercising apparatus as defined in claim 1, wherein at least three spaced nocthes are provided at each end of said apparatus for providing more than three deflection versus load characteristics.

4. An exercising apparatus as defined in claim 1, wherein said support means makes line supporting contact with said sheet member only along two spaced transverse lines, one at each end of said sheet member.

* * * * *